US007175354B2

(12) United States Patent
Niimi et al.

(10) Patent No.: US 7,175,354 B2
(45) Date of Patent: Feb. 13, 2007

(54) INKJET PRINTING DEVICE

(75) Inventors: Akiko Niimi, Kasugai (JP); Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 184 days.

(21) Appl. No.: 10/949,314

(22) Filed: Sep. 27, 2004

(65) Prior Publication Data

US 2005/0068400 A1 Mar. 31, 2005

(30) Foreign Application Priority Data

Sep. 26, 2003 (JP) ..... 2003-335790

(51) Int. Cl.
*B41J 2/01* (2006.01)
*B41J 3/407* (2006.01)

(52) U.S. Cl. ..... 400/48; 400/23; 400/648; 400/649; 347/104; 101/35

(58) Field of Classification Search ..... None
See application file for complete search history.

(56) References Cited

U.S. PATENT DOCUMENTS 5,199,353 A * 4/1993 Szyszko ..... 101/474
5,327,827 A * 7/1994 Richardson ..... 101/126
6,095,628 A 8/2000 Rhome ..... 347/4
6,908,190 B2 * 6/2005 Iwatsuki et al. ..... 347/104
7,040,748 B2 * 5/2006 Niimi et al. ..... 347/104

FOREIGN PATENT DOCUMENTS

JP 09058073 A * 3/1997

OTHER PUBLICATIONS

Machine translation of JP 09058073 to Saka from Japanese Patent Office website.*

* cited by examiner

*Primary Examiner*—Daniel J. Colilla
(74) *Attorney, Agent, or Firm*—Oliff & Berridge, PLC

(57) ABSTRACT

There is provided an inkjet printing device, which is provided with a holding unit that is used to hold a substrate to be subjected to printing operation, and an inkjet head that ejects ink onto the substrate held by the holding unit. The holding unit is movable between a first posture which allows the inkjet head to eject the ink onto the substrate held by the holding unit and a second posture in which the substrate is loaded onto the holding unit.

18 Claims, 13 Drawing Sheets

INKJET PRINTING DEVICE

BACKGROUND OF THE INVENTION

The present invention relates to an inkjet printing device used for printing images such as photographs or designs on a substrate.

For printing photographs or designs on a substrate such as fabric and a sheet, a screen printing technique is frequently used. In the screen printing, on the fabric, for example, a stencil is placed, and then ink is pressurized to be transferred through the stencil from the outside of the stencil. Thus, an image is printed on the fabric.

Since the screen printing requires that an ink image is formed on the stencil before printing operation, making screens is troublesome. Further, production cost is increased when the image to be printed is an intricately colored image (e.g., a landscape picture or a portrait) although the screen printing is convenient for a monotonal color pattern image or a monochrome pattern image.

To avoid the above mentioned problem of the screen printing, recently the inkjet printing device for forming an image on the fabric is widely used. In general, the inkjet printing device includes an inkjet head having a plurality of ejection channels. In the inkjet head, actuators such as heater elements and piezoelectric devices are selectively driven to eject ink from desired ones of a plurality of nozzles provided at tip portions of the plurality of ejection channels.

In many cases, the substrate on which the image is formed by the inkjet printing device is a standard sheet. In the inkjet printing device that uses the standard sheet as the substrate, the image is formed on the sheet while the sheet is carried along a sheet carrying path.

With regard to the inkjet printing device which uses the fabric (e.g., a T-shirt) as the substrate, unlike a sheet it is difficult to set a T-shirt at a proper position and keep its shape unchanged while the T-shirt is carried along a carrying path in the inkjet printing device. Therefore, in general a platen is used in the inkjet printing device to set a T-shirt and keep its shape unchanged while the T-shirt is carried in the inkjet printing device. In the inkjet printing device, the platen holding the T-shirt is moved relative to the inkjet head while the ink is ejected from the inkjet head.

When the printing operation is performed, it is required to precisely position the T-shirt with respect to the inkjet head so that the ink is ejected at required positions on the T-shirt.

In U.S. Pat. No. 6,095,628, the inkjet printing device for the fabric is disclosed. In this inkjet printing device, an inkjet head is supported on a housing such that the inkjet head can reciprocate in a lateral direction, and a platen is supported on two rails such that the platen can move along the two rails in a longitudinal direction of the housing. With this structure, the platen holding the T-shirt is precisely positioned with respect to the inkjet head.

By loading the T-shirt onto the platen, the position of the T-shirt with respect to the inkjet head is precisely fixed. Then, the platen is moved to a position beneath the inkjet head with a holding surface of the platen being kept horizontally. Next, the inkjet head ejects the ink in the downward direction to form an image on the T-shirt.

Before the T-shirt is loaded onto the platen, the platen is firstly moved to a front end position. Then, a worker loads the T-shirt onto the platen by pushing the bottom of the T-shirt toward the rear side of the housing of the inkjet printing device from the front side.

The T-shirt is loaded onto the platen so that a working surface (on which the image is printed) of the T-shirt faces the upward direction. Then, the direction of the working surface is adjusted and the position of the platen with respect to the inkjet head is adjusted.

SUMMARY OF THE INVENTION

One of problems of such a conventional inkjet printing device for the fabric is that the loading of the T-shirt onto the platen is difficult because the worker is required to push the bottom of the T-shirt from the front side toward the rear side of the housing. Also, the adjustment of the direction of the working surface is difficult for the worker because the T-shirt is directed upside down after the T-shirt is loaded onto the platen. For this reason, a lot of experience is required for the worker to precisely position the T-shirt.

The present invention is advantageous in that it provides an inkjet printing device configured such that a worker can easily load fabric onto a platen and can easily position the fabric on the platen.

According to an aspect of the invention, there is provided an inkjet printing device, which is provided with a holding unit that is used to hold a substrate to be subjected to printing operation, and an inkjet head that ejects ink onto the substrate held by the holding unit. The holding unit is movable between a first posture which allows the inkjet head to eject the ink onto the substrate held by the holding unit and a second posture in which the substrate is loaded onto the holding unit.

With this configuration, since the holding unit can be moved between the first posture and the second posture, a user can easily loads the substrate onto the holding unit and can easily adjust a direction and a position of the substrate. Consequently, working efficiency is enhanced.

Optionally, the inkjet printing device may include a bearing that is located at one end portion of the holding unit to move the holding unit between the first posture and the second posture.

Still optionally, the holding unit may be rotatably supported by the bearing at one end portion of the holding unit so that the holding unit is rotated, around the bearing, between the first posture and the second posture.

Still optionally, the inkjet printing device may include a locking mechanism that brings the holding unit into a locked state at the first posture and the second posture.

In a particular case, the holding unit may have a holding surface on which the substrate is held. The holding surface faces the inkjet head when the holding unit is at the first posture. At the first posture, the holding surface of the holding unit is oriented to a horizontal direction.

In a particular case, at the second posture, the holding unit may be raised such that an angle ranging from 10° through 120° is formed between the holding unit at the first posture and the holding unit at the second posture.

Optionally, the holding unit may be movably supported in a first direction.

Still optionally, the inkjet head may be movably supported in a second direction different from the first direction.

In a particular case, when the holding unit is at the second posture, the holding unit may be raised toward a front side of the inkjet printing device.

Optionally, the front side may be a side on which a user loads the substrate onto the holding unit.

Still optionally, the inkjet printing device may include an operation panel for controlling the inkjet printing device. The operation panel is located on the front side of the inkjet printing device.

In a particular case, when the holding unit is at the second posture, the holding unit may be raised toward a rear side of the inkjet printing device. In this case, the substrate is loaded by a user onto the holding unit from a front side of the inkjet printing device.

Optionally, the inkjet printing device may include a supporting member on which the holding unit is fixed, the holding unit being moved from the first posture to the second posture together with the supporting member.

Still optionally, the inkjet printing device may include a carriage member that movably supports the supporting member so that the holding unit fixed on the supporting member being moved between the first posture and the second posture, and a guide rail that slidably supports the carriage member so that the carriage member is moved along the guide rail.

Still optionally, the inkjet printing device may include a housing that has a size for accommodating the holding unit. The guide rail is formed to carry the carriage member into an inside of the housing from an outside of the housing and to carry the cartridge member out of the housing.

According to another aspect of the invention, there is provided an inkjet printing device, which is provided with a holding unit that is used to hold fabric to be subjected to printing operation, and an inkjet head that ejects ink onto the fabric held by the holding unit. The holding unit is movable between a first posture in which the inkjet head ejects the ink onto the fabric held by the holding unit and a second posture in which the fabric is easily loaded onto the holding unit.

With this configuration, since the holding unit can be moved between the first posture and the second posture, a user can easily loads the fabric onto the holding unit and can easily adjust a direction and a position of the fabric. Consequently, working efficiency is enhanced.

Optionally, the inkjet printing device may include a bearing that is located at one end portion of the holding unit to move the holding unit between the first posture and the second posture.

Still optionally, the inkjet printing device may include a locking mechanism that brings the holding unit into a locked state at the first posture and the second posture.

Still optionally, the holding unit may have a holding surface on which the fabric is held. The holding surface faces the inkjet head when the holding unit is at the first posture. Further, at the first posture, the holding surface of the holding unit is oriented to a horizontal direction.

Still optionally, at the second posture, the holding unit may be raised such that an angle ranging from 10° through 120° is formed between the holding unit at the first posture and the holding unit at the second posture.

BRIEF DESCRIPTION OF THE ACCOMPANYING DRAWINGS

DETAILED DESCRIPTION OF THE EMBODIMENTS

Hereafter, an embodiment according to the invention will be described with reference to the accompanying drawings.

Figure 1:
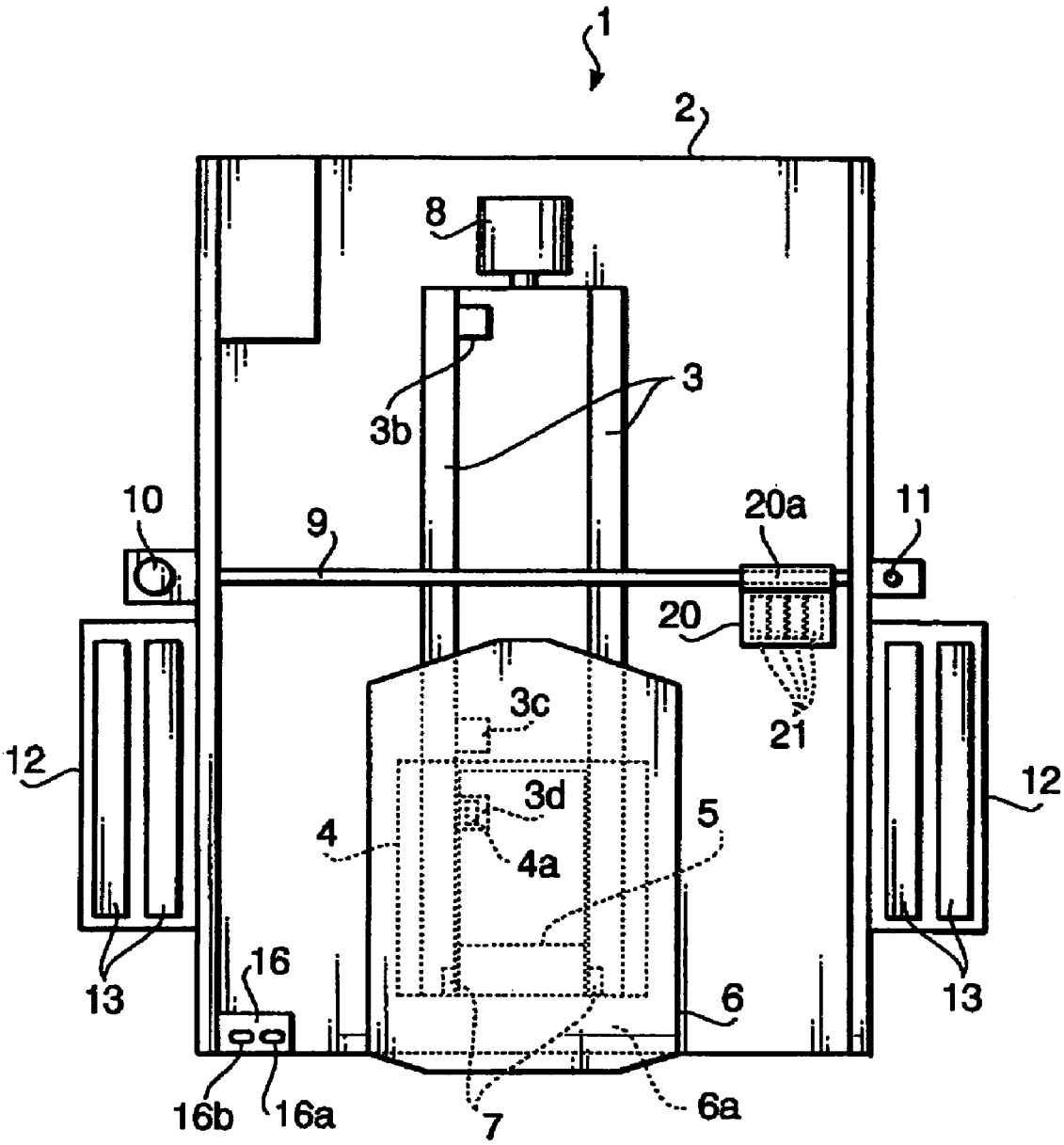
FIG. 1 is a plan view of an inkjet printer according to an embodiment of the invention.
Figure 2:
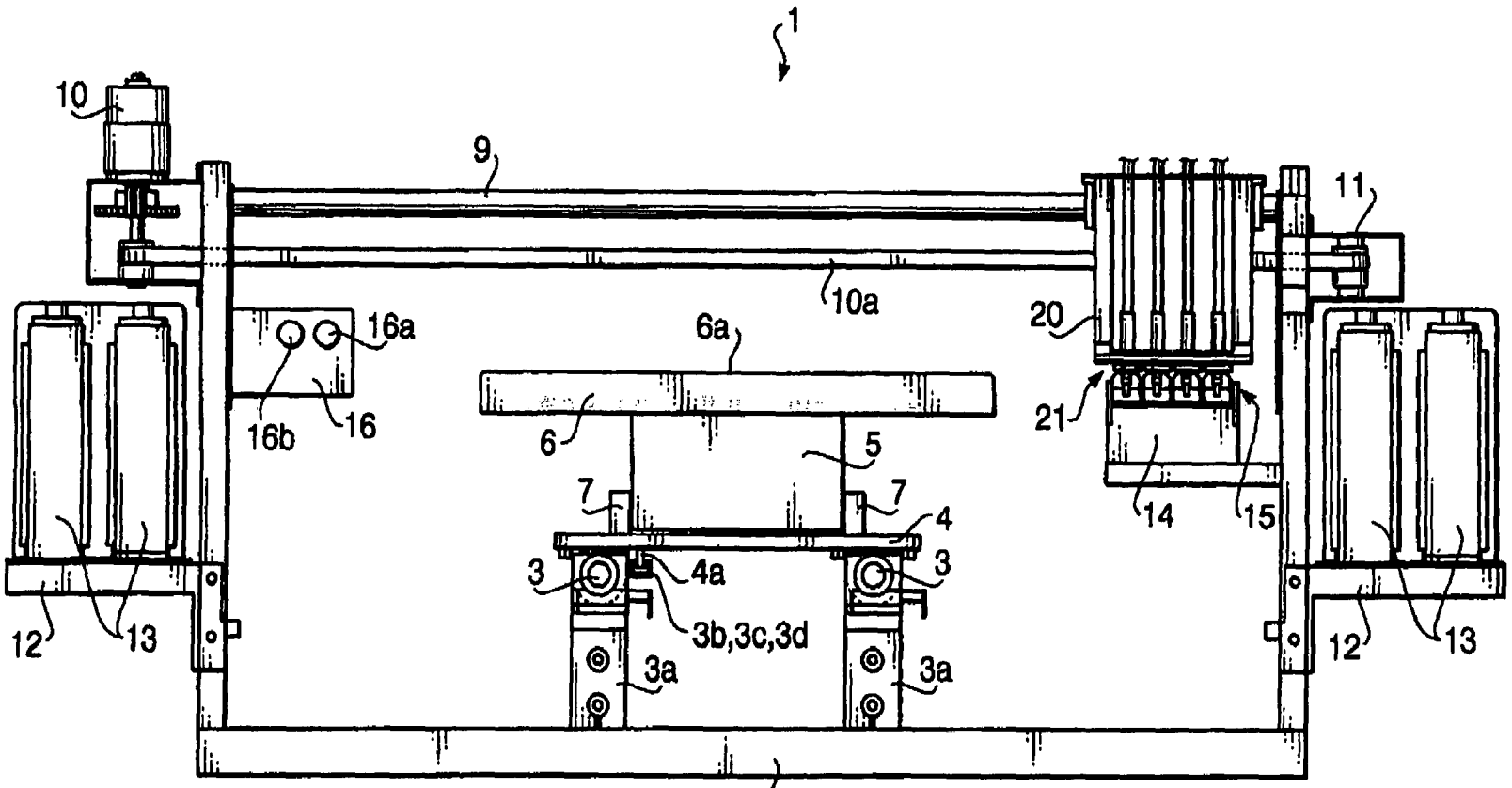
FIG. 2 is a front view of the inkjet printer.
Figure 3:
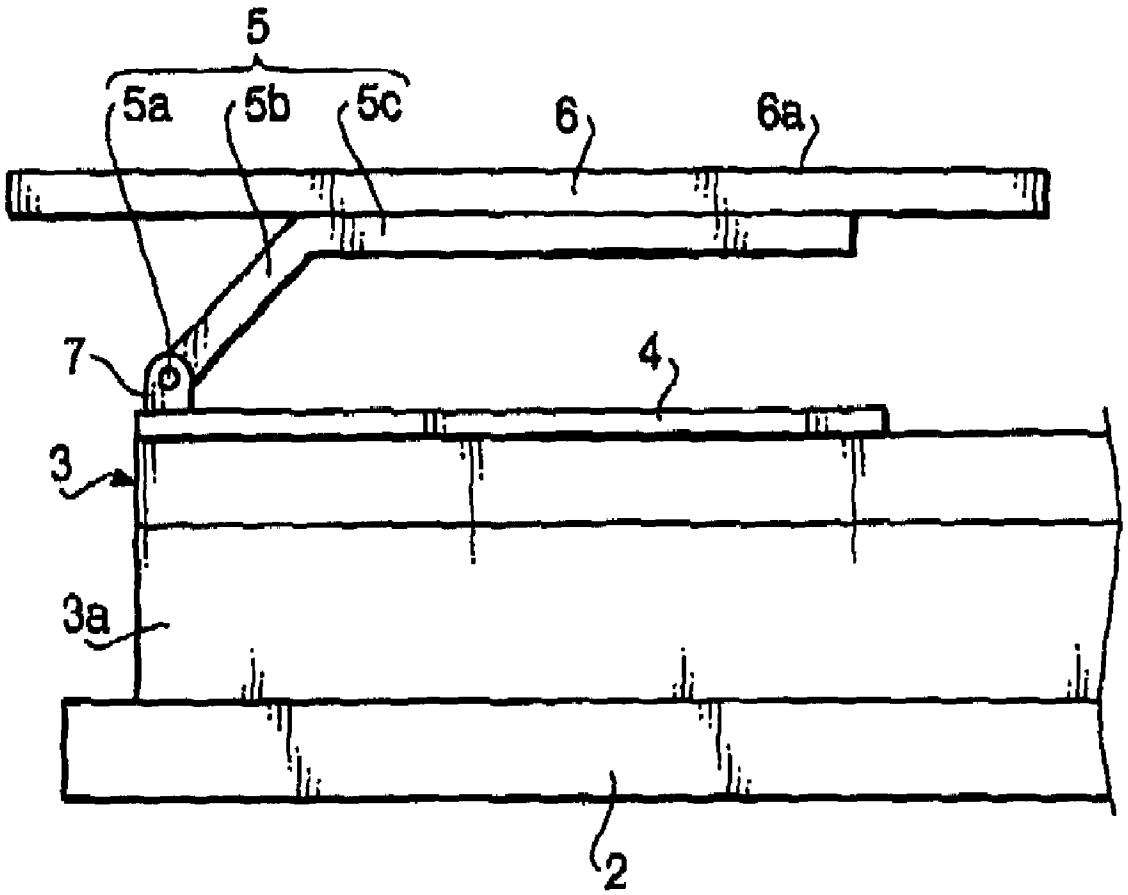
FIG. 3 is a side view of the inkjet printer illustrating a situation where a platen is in a horizontal position.

FIG. 1 is a plan view of an inkjet printer 1 according to an embodiment of the invention. FIG. 2 is a front view of the inkjet printer 1. FIG. 3 is a side view of the inkjet printer 1 illustrating a situation where a platen 6, formed to be a plate-like member, is in a horizontal position. The front side of the inkjet printing device 1 corresponds to the downward side of FIG. 1, the front surface side of FIG. 2, and the leftward side of FIG. 3.

As shown in FIGS. 1 and 2, the inkjet printer 1 has a housing 2 having a form of a rectangular solid. The rectangular solid shape of the housing 2 has longer sides parallel with an anteroposterior direction of the housing 2. At a central position of the bottom portion of the housing 2, two guide rails 3 and 3 are provided in parallel with the anteroposterior direction. The two guide rails 3 and 3 are respectively supported on two bases 3*a* and 3*a* which are formed on a bottom surface of the housing 2 in parallel with the anteroposterior direction.

On the tops of the two guide rails 3 and 3, a carriage member 4 is supported slidably along the two guide rails 3 and 3.

As shown in FIG. 3, at the front end of the carriage member 4, a tip portion of a support rod 5, having a shape elongated from the front end toward the rear side of the housing 2, is attached. The support rod 5 has a form of a thick plate. More specifically, the support rod 5 has a base part 5*b* having a length of one third of the entire length of the support rod 5, and a horizontal part 5*c* which is kept horizontally when the support rod 5 is situated at a posture as shown in FIG. 3.

At the front end of the carriage member 4, a pair of shaft bearings 7 are fixed to rotatably support the support rod 5 around supporting shafts 5*a* provided on right and left sides of a tip portion of the base part 5*b*.

As shown in FIG. 1, the platen 6 has a rectangular form of which longer sides are parallel with the anteroposterior direction of the housing 2 when it is viewed as the plan view. The plate 6 has a support surface 6*a* facing the upward direction. The plate 6 functions as a holding unit for holding fabric (e.g., a T-shirt). Before printing operation is performed, the T-shirt is loaded onto the platen 6 (i.e., laid over the platen 6) such that a working surface (on which an image or a design is to be printed) of the T-shirt faces the upward direction.

The support surface 6*a* holds the T-shirt so that the working surface of the T-shirt is kept horizontally while the support surface 6*a* is opposed to an inkjet head 21 and ink is ejected from the inkjet head 21.

On the top surface of the platen 6, anti slip member is provided so that the appropriate condition of the T-shirt, positioned appropriately in a state of tension on the support surface 6*a*, is not lost while the printing operation is performed.

As shown in FIG. 1, corners of the platen 6 are cut such that each of the front end portion and the rear end portion of the platen 6 has a trapezoidal form, by which the position adjustment of the T-shirt on the support surface 6*a* becomes easier. The corners of the rear end portion of the platen 6 are cut more largely than the corners of the front end portion of the platen 6 because the T-shirt is loaded onto the platens 6 with its bottom being located at the front end portion of the platen 6 and its neck being located at the rear end portion of the platen 6.

With this structure, the fabric such as a T-shirt fits in the platen 6, and the T-shirt is difficult to be wrinkled during the printing operation.

The inkjet printer 1 further provided with a platen motor 8 at the rear side of the guide rails 3. The platen motor 8 is used to move the carriage member 4 in the anteroposterior direction. More specifically, a driving belt (not shown) is hung on a driving shaft of the platen motor 8 and a pulley provided at the front end portion of the guide rails 3, so that the carriage member 4 fixed on the driving belt is carried by the driving force of the platen motor 8 along the guide rails 3 in the anteroposterior direction.

The inkjet printer 1 is further provided with photo sensors 3*b*, 3*c* and 3*d*. The photo sensor 3*b* is located at the rear end of the housing 2 so as to determine whether or not the platen 6 is at a start point of the printing operation. The photo sensor 3*c* is located on the front side of the housing 2 so as to determine whether or not the platen 6, which is moved toward the front end of the guide rails 3 when the printing operation is performed, reaches an endpoint of the printing operation. The photo sensor 3*d* determines whether the platen 6 is at a position where the T-shirt can be loaded onto the platen 6.

Each of the photo sensors 3*b*, 3*c* and 3*d* includes a light emitting device and a light receiving device, and detects a subject placed between the light emitting device and the light receiving device when the light emitted by the light emitting device is not received by the light receiving device.

On the bottom surface of the carriage member 4, a shielding plate 4*a* protruding downwardly in the vertical direction from the bottom surface is formed, so that the positions of the carriage member 4 are appropriately detected by the photo sensors 3*b*, 3*c* and 3*d*.

The platen motor 8 is, for example, a stepping motor. Based on the positions such as the start point and endpoint detected by the photo sensors 3*b*, 3*c* and 3*d*, the platen motor 8 (the stepping motor) is driven, so that the current position of the carriage member 4 is correctly determined.

As shown in FIG. 1, the inkjet printer 1 is further provided with a carriage 20 accommodating inkjet heads 21. The carriage 20 is slidably engaged with a guide rail 9 at a catching part 20*a* and is moved along the guide rail 9 attached to the both side walls of the housing 2. The guide rail 9 is elongated in a lateral direction.

At the left end portion of the guide rail 9, a carriage motor 10 is provided. Further, at the right end portion of the guide rail 9, a pulley 11 is provided (see FIG. 2). The carriage 20 is moved along the guide rail 9 in the lateral direction by driving a carriage belt 10*a*, hung on a driving shaft of the carriage motor 10 and the pulley 11 under the guide rail 9, to which the carriage 20 is fixed on a rear side of the carriage 20. That is, the carriage 20 reciprocates along the guide rail 9 in the lateral direction.

The carriage motor 10 is, for example, a DC motor. The position of the carriage 20 is determined based on an output of a linear encoder (not shown) provided on the guide rail 9.

As shown in FIG. 2, the carriage 20 accommodates four inkjet heads 21 respectively corresponding to color components of cyan, magenta, yellow and black. Each of the inkjet heads 21 has, for example, 128 ink ejection channels for ejecting ink.

Each ink ejection channel has a nozzle on the bottom surface of the inkjet head 21. Further, each ink ejection channel has a piezoelectric actuator. By selectively driving the piezoelectric actuators, the ink can be ejected from desired ones of the nozzles (ink ejection channels) in the downward direction.

On the both side walls of the housing 2, cartridge cases 12 are respectively provided. Each cartridge case 12 is configured such that two ink cartridges 13 and 13 can be detachably attached thereto. The ink is supplied from the ink cartridges 13 to respective ones of the inkjet heads 21 via tubes (not shown).

At the right end position of the guide rail 9, a maintenance unit 14 having a suction cap 15 is located. When the cartridge 20 is located at the right end position, the suction cap 15 closely contacts with nozzle surfaces (on which the nozzles are formed) of the inkjet heads 21. When the suction cap 15 contacts with the nozzle surfaces of the inkjet heads 21, head cleaning of the inkjet heads 21 is conducted by suctioning the ink from the nozzle surfaces through the suction cap 15 by a suction pump (not shown) provided in the maintenance unit 14.

Since the nuzzle surfaces are covered with the suction cap 15 when the printing operation is not performed, drying of the ink on the nozzle surface is prevented.

The inkjet printer 1 is further provided with an operation panel 16 on which a plurality of operation buttons for controlling the inkjet printer 1 including a print start button 16*a* and a reload button 16*b* are provided. After the user loads the T-shirt onto the platen 6, the user operates the print start button 16*a* to instruct the inkjet printer 1 to start the printing operation. The user operates the reload button 16*b* to move the platen 6 to the front end position of the housing 2 and to load the T-shirt onto the platen 6.

Next, the printing operation is explained in detail. Firstly, the platen 6 is moved to the front end position at which the shielding plate 4*a* of the carriage member 4 is detected by the photo sensor 3*d*. When the platen 6 is at the front end position, the user raised the platen 6 toward the front end of the housing 2 by rotating the platen 6 around the supporting shafts 5*a*. When the platen 6 is raised, for example, by 45 degrees from the horizontal position, the platen 6 is brought in a locked state.

Since the platen 6 is raised (i.e., rotated around the supporting shafts 5*a*), the user can easily loads the T-shirt onto the platen 6. Further, since the platen 6 is locked at the raised position, the user can securely loads the T-shirt onto the platen 6.

Figure 4:
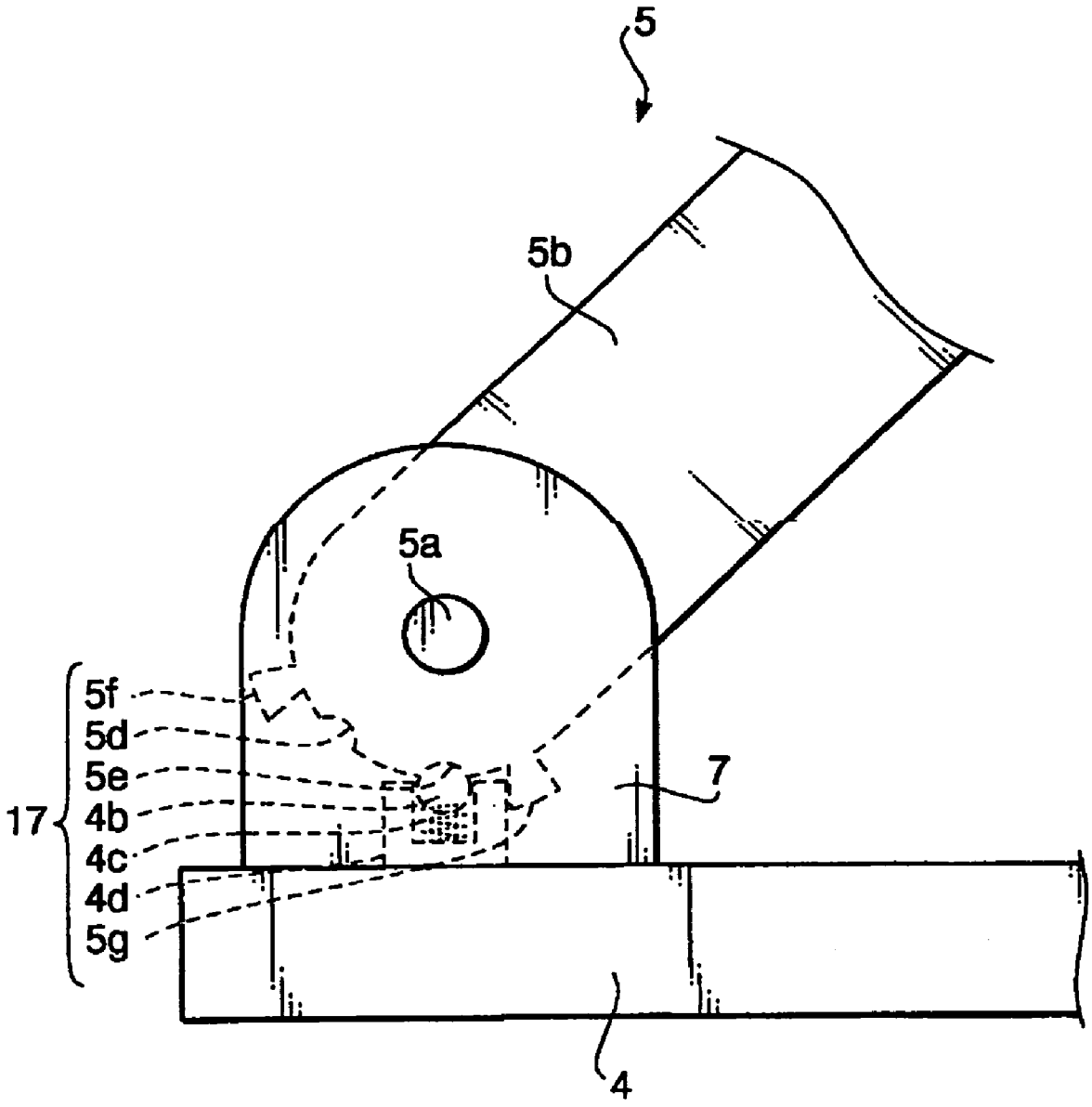
FIG. 4 is a side view of a rocking mechanism when a support rod is at a reclined position.
Figure 5:
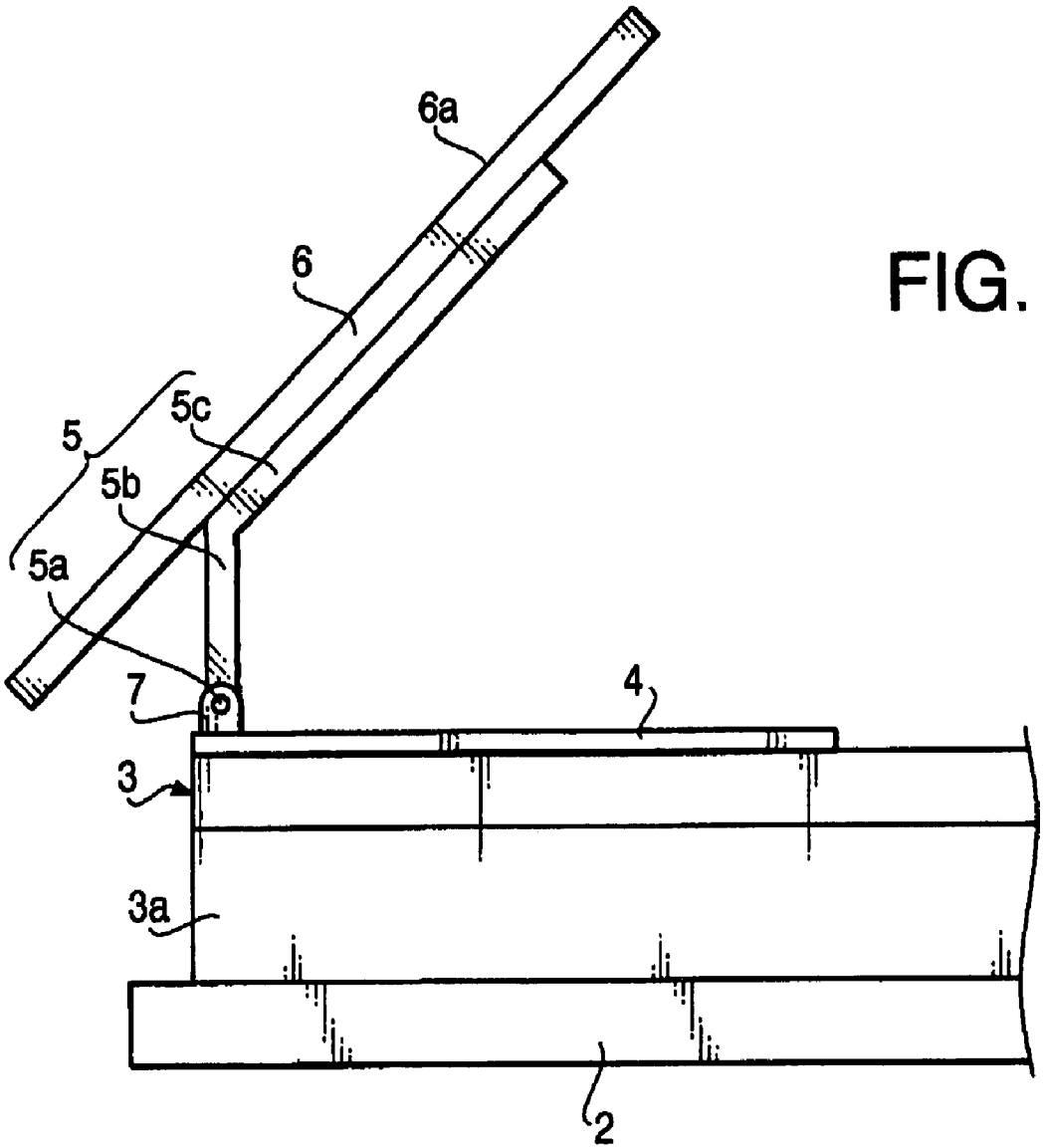
FIG. 5 is a side view of the inkjet printer illustrating a situation where the support rod is at a raised position.

Hereafter, a locking mechanism 17 for locking the support rod 5 at predetermined rotation positions will be described with reference to FIGS. 4 through 7. FIG. 4 is a side view of the support rod 5 and the carriage member 4 illustrating in detail a structure of the tip portion of the base part 5*b* of the support rod 5. FIG. 4 shows a situation where the support rod 5 is at a reclined position (i.e., the horizontal part 5*c* of the support rod 5 is in the horizontal position). FIG. 5 is a side view of the inkjet printer 1 illustrating a situation where the support rod 5 is at the raised position. In a posture of the platen 6 shown in FIG. 5, the platen 6 has been rotated around the supporting shaft 5*a* by 45° with respect to the reclined position.

Figure 6:
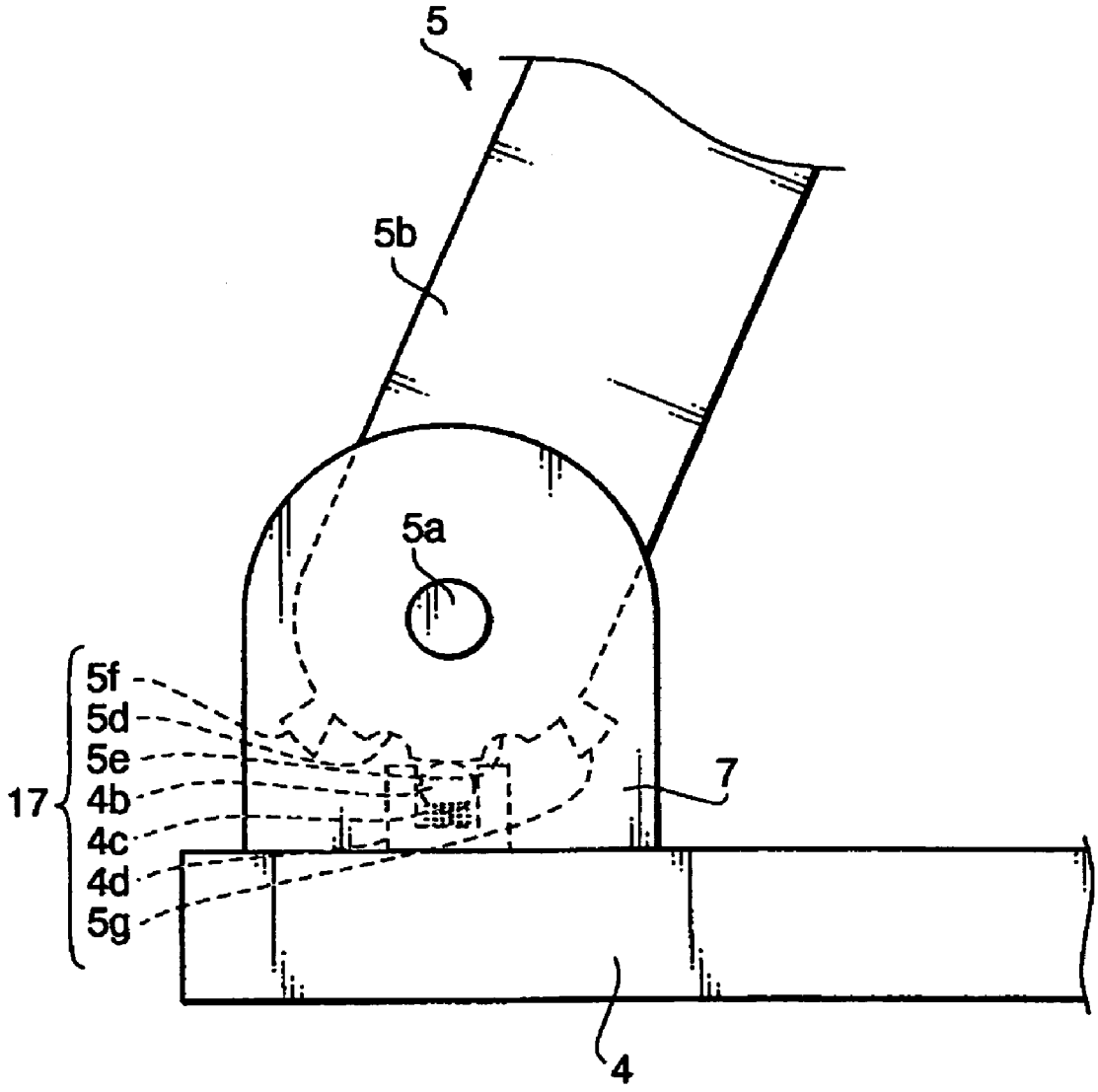
FIG. 6 is a side view of the rocking mechanism when the support rod is at an intermediate position.
Figure 7:
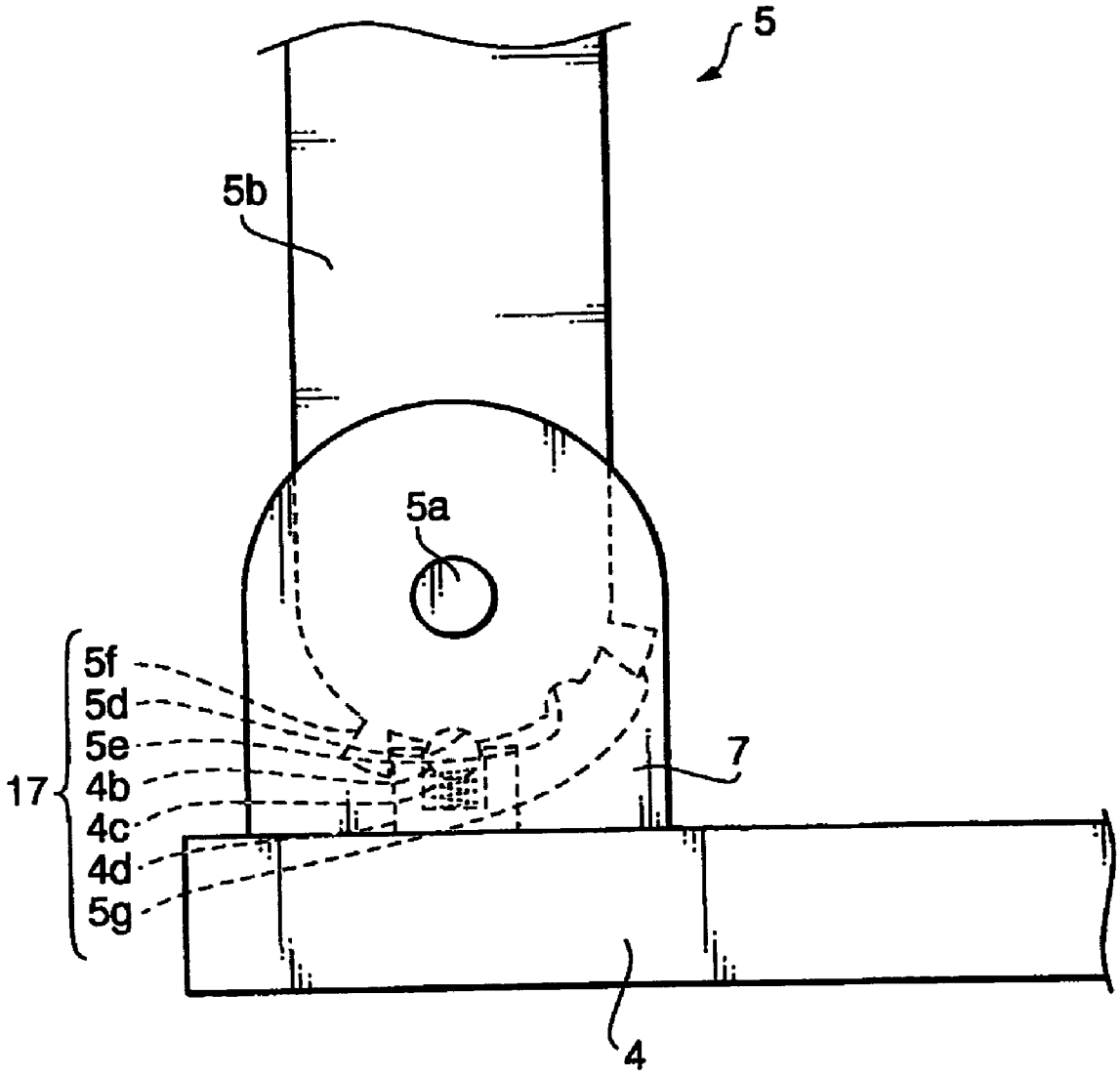
FIG. 7 is a side view of the rocking mechanism when the support rod is at a raised position.

FIG. 6 is an enlarged view (the side view) of the base part 5*b* of the support rod 5 illustrating a situation where the support rod 5 is at a position between the reclined position and the raised position. FIG. 7 is an enlarged view (the side view) of the base part 5*b* of the support rod 5 illustrating a situation where the support rod 5 is at the raised position. In each of FIGS. 4 through 7, the left side corresponds to the front side of the inkjet printer 1.

As shown in FIG. 4, at the portion of each of the pair of shaft bearings 7 (located at the front end of the both sides of the carriage member 4), the rocking mechanism 17 is provided. The rocking mechanism 17 brings the support rod 17 into a locked state when the support rod is at the reclined position (i.e., the supporting surface 6*a* of the platen 6 is in the horizontal position) and when the support rod 5 is at the raised position (i.e., the supporting surface 6*a* of the platen 6 is rotated toward the front side of the housing around the supporting shafts 5*a*).

The rocking mechanism 17 includes a rocking sphere 4*b*, a spring 4*c* and a case 4*d* which are provided as parts of the carriage member 4. The case 4*d* accommodating the rocking sphere 4*b* and the spring 4*c* is fixed on the top surface of the carriage member 4. The rocking mechanism 17 further includes catching portions 5*d* and 5*e*, and stoppers 5*f* and 5*g* which are formed at the tip portion of the base part 5*b* of the support rod 5.

The rocking sphere 4*b* has a spherical shape and is pressed, by the spring 4*c*, against the periphery of the tip portion of the base part 5*b* of the support rod 5. The case 4*d* guides the moving direction of the rocking sphere 4*b*.

Further, the case 4*d* functions as a member to limit a rotational movement of the support rod 5 to a predetermined rotation range. More specifically, the stopper 5*g* touches a side wall of the case 4*d* when the support rod 5 is at the reclined position, so that the rotational movement of the support rod 5 over the reclined position is limited. The stopper 5*f* touches another side wall of the casing 4*d* when the support rod 5 is raised by the user, so that the rotational movement of the support rod 5 over the raised position is limited.

The catching portions 5*d* and 5*e* are formed as recessed portions which are recessed from the periphery of the tip portion of the baser part 5*b*. When the support rod 5 is at the reclined position, the locking sphere 4*b* engages with the catching portion 5*e* of the support rod 5, by which the support rod 5 is rocked at the reclined position (see FIG. 4). When the support rod 5 is at the raised position, the locking sphere 4*b* engages with the catching portion 5*d* of the support rod 5, by which the support rod 5 is rocked at the raised position (see FIG. 7).

That is, when the support rod 5 is at the reclined position, the rotational movement of the support rod 5 in the clockwise direction is limited by the stopper 5*g* and the rotational movement in the counterclockwise direction is limited by the engagement of the rocking sphere 4*b* and the catching portion 5*e*.

Before the user loads the T-shirt onto the platen 6, the user raises the platen 6 (the support rod 5) toward the raised position as shown in FIG. 5. Since the platen 6 approaches the user as the platen 6 is rotated around the supporting shafts 5*a* toward the raised position and thereby the user can get at the platen 6, the user can easily loads the T-shirt onto the platen 6 even though the upper portion of the platen 6 is inclined toward the rear side of the housing 2.

When the platen 6 is rotated around the supporting shafts 5*a* from the reclined position toward the raised position, the rocking sphere 4*b* is pressed by the periphery of the tip portion of the base part 5*b* and is moved toward the bottom surface of the case 4*d* against the restoring force of the spring 4*c*, so that the engagement (the rocked state) of the rocking sphere 4*b* and the catching portion 5*e* is released. FIG. 6 shows a situation where the base part 5*b* is in an intermediate position between the reclined position and the raised position. In the situation shown in FIG. 6, the engagement of the rocking sphere 4*b* and the catching portion 5*e* is released.

When the base part 5*b* is further raised from the intermediate position shown in FIG. 6, the stopper 5*f* touches the side wall of the case 4*d* and the rocking sphere 4*b* engages with the catching portion 5*d* (see FIG. 7). In this situation shown in FIG. 7, the rotation movement of the support rod 5 in the counterclockwise direction is limited by the stopper 5*f* and the rotation movement of the support rod 5 in the clockwise direction is limited by the engagement of the rocking sphere 4*b* and the catching portion 5*d*.

With the above mentioned configuration, the user can load the T-shirt onto the platen 6 while the working surface (on which an image or a design is to be printed) of the T-shirt faces to the user. Further, the user can load the -T-shirt onto the platen 6 without handling the T-shirt oriented upside down. Therefore, the user can easily check the position and the direction of the T-shirt and can easily correct the misalignment of the position and the direction of the T-shirt.

After the T-shirt is loaded onto the platen 6 correctly, the user presses the platen 6 to recline the platen 6 to the reclined position. As described above, when the platen 6 is reclined, the rocking mechanism 17 is brought into the rocked state again.

After the platen is reclined, the user operates the print start button 16*a* to start the printing operation. When the print start button 16*a* is pushed, the platen motor 8 is driven to move the platen 6 toward the rear side of the housing 2 until the photo sensor 3*b* detects the shielding plate 4*b*. Afterward, the carriage member 4 is moved toward the front side of the housing 2 at a constant speed.

While the carriage member 4 is moved at the constant speed from the rear end position toward the front side, the carriage 20 reciprocates in the lateral direction by the driving force of the carriage motor 10. Further, while the carriage 20 reciprocates in the horizontal direction, the ink ejection channels of each of the inkjet heads 21 are selectively driven to eject the ink from the desired ones of the nozzles onto the working surface of the T-shirt.

When the platen 6 reaches to the position at which the shielding plate 4*a* is detected by the photo sensor 3*c*, the platen 6 is stopped and the inkjet printer enters a standby state where the inkjet printer 1 waits until the T-shirt is ready to be detached from the platen 6, i.e., for ink setting. After the standby state is finished, the user can move the platen 6 to the front end position at which the shielding plate 4*a* is detected by the photo sensor 3*d* by pushing the reload button 16*b*. It should be noted that until the standby state is finished (e.g., until a predetermined time has elapsed from the last ink ejection onto the T-shirt), the platen 6 does not move even if the reload button 16*b* is pushed by the user.

After the platen 6 is moved to the front end position, the user can easily detach the T-shirt from the platen 6 by raising the platen 6 to the raised position. Next, the user loads a next T-shirt on to the platen 6 to start the next printing operation.

Although the present invention has been described in considerable detail with reference to certain preferred embodiments thereof, other embodiments are possible. Hereafter, variations of the above mentioned embodiment are described. In the following drawings, to elements which are substantially the same as those of the above mentioned embodiment, the same reference numbers are assigned and explanations thereof are not repeated.

Although in the above mentioned embodiment, the platen 6 is exactly oriented to the horizontal direction when it is in the reclined position, it is not necessarily required that the platen 6 is exactly oriented to the horizontal direction. The platen 6 may be oriented to a substantially horizontal direction.

Although in the above mentioned embodiment, the operation panel 16 includes two separate buttons 16*a* and 16*b* respectively used for instructing the inkjet printer 1 to start the printing operation and for moving the platen 6 to the front end position, the reload button 16*b* may have both of the functions of the two buttons 16*a* and 16*b*. In this case, when the user pushes the reload button 16*b*, the platen 6 is moved to the front end position and then the inkjet printer 1 enters a standby state for a certain time period before the inkjet printer initiates the printing operation. In this case, only one action is required to start the printing operation.

Although the rocking mechanism 17 includes the round catching portion 5*d* (5*e*) and the rocking sphere 4*b* having the spherical shape, the catching portion 5*d* (5*e*) and the rocking sphere 4*b* may have another structure. For example, the catching portion may have a rectangular shape, and a hook member having a lever may be provided on the carriage member 4 in place of the rocking sphere 4*b* so that the rocking of the support rod 5 and the carriage member 4 is attained by the engagement of the rectangular catching portion of the base part 5*b* and the hook member of the carriage member 4.

In this structure, the rocking mechanism may be configured such that by pushing the lever of the hook member, the spring 4*c* is pressed and the engagement of the hook member and the rectangular catching portion is released and thereby the supporting rod 5 becomes rotatable. Further, at the rocking position, the hook member is engaged with the rectangular catching portion by the restoring force of the spring 4*c*. Alternatively to the spring 4*c*, another elastic member may be used.

Figure 8:
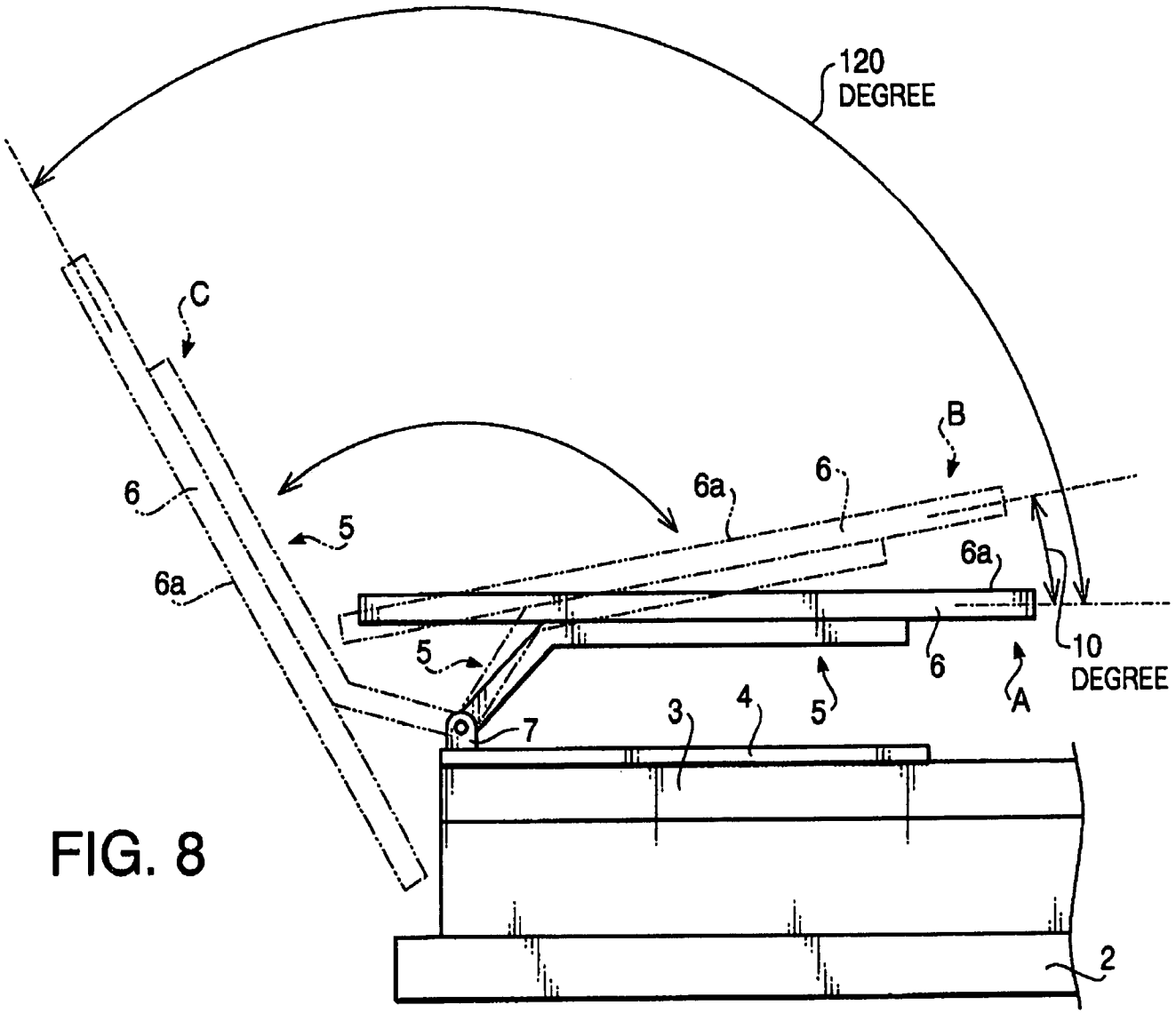
FIG. 8 is a side view of the inkjet printer explaining a configuration in which the platen can be rotated by an angle raging from 10° through 120°.

Although, in the above mentioned embodiment, the angle of the supporting surface 6*a* at the raised position with respect to the horizontal direction is 45°, another angle may be formed between the supporting surface 6*a* at a raised state B or C (see FIG. 8) and the horizontal direction. For example, the angle of the supporting surface 6*a* at the raised state B with respect to the horizontal direction (a horizontal state A) may be 10°. The angle of the supporting surface 6*a* at the raised state C with respect to the horizontal direction may be 120°. An angle between 10° and 120° may be formed between the supporting surface 6*a* at the raised position and the horizontal direction.

When the angle of the supporting surface 6*a* at the raised position with respect to the horizontal direction is larger than or equal to 10° and smaller than 90°, the user can loads the fabric (e.g., a T-shirt) onto the platen 6 while paying attention to the supporting surface 6*a*. Therefore, the user can easily adjust the position of the fabric on the supporting surface 6*a*.

When the angle of the supporting surface 6*a* at the raised position with respect to the horizontal direction is larger than or equal to 90° and smaller than or equal to 120°, the upper side of the platen 6 is inclined toward the front side. Therefore, the work for loading the T-shirt onto platen 6 from the bottom toward the neck of the T-shirt becomes further easier.

Figure 9:
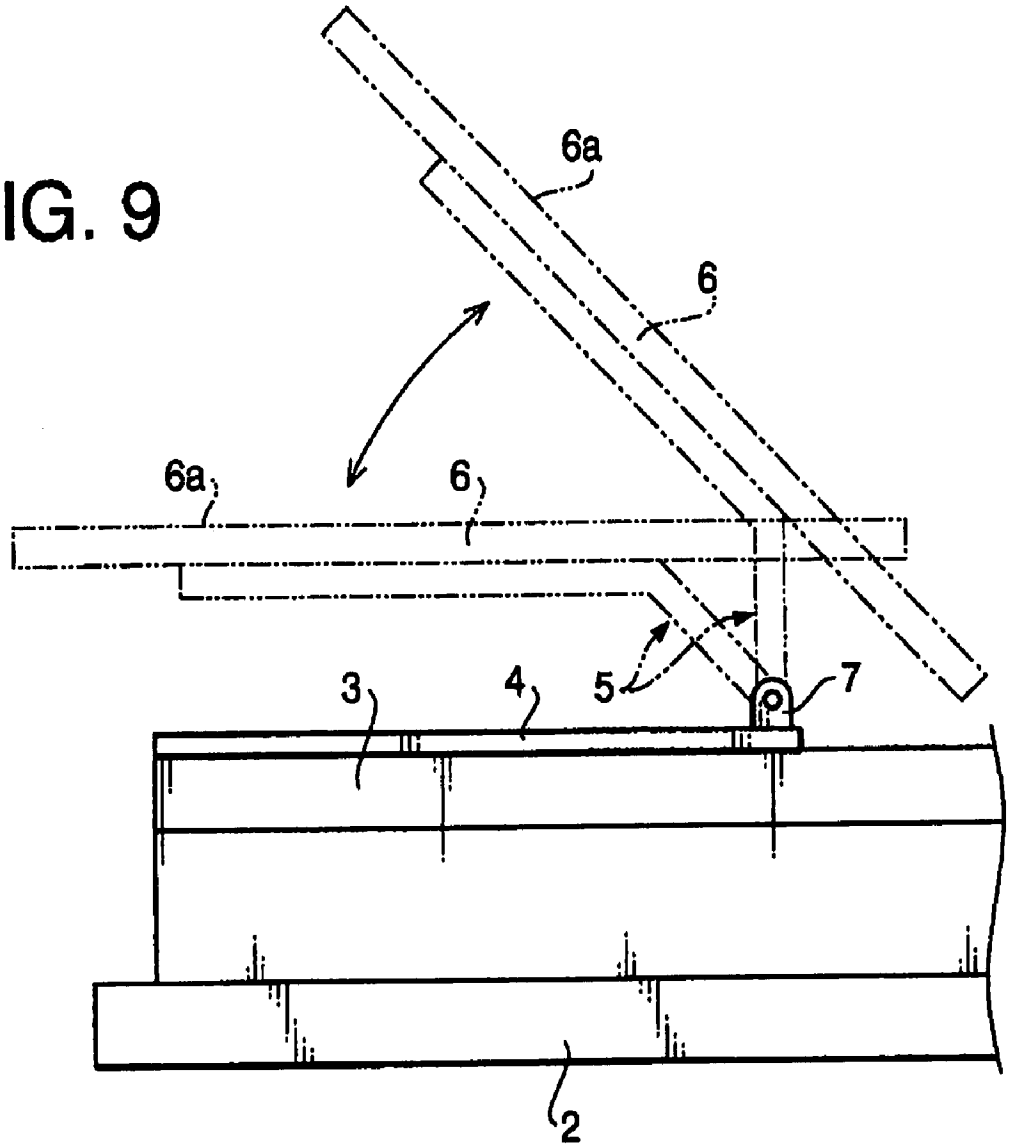
FIG. 9 is a side view of the inkjet printer illustrating a configuration in which the platen is raised toward a rear side of the inkjet printer.

The inkjet printer may be configured such that the shaft bearings 7 are located at the rear end of the carriage member 4 and the supporting rod 5 is raised (i.e., rotated) toward the rear side around the shaft bearing 7 located at the rear end (see FIG. 9). In this case, event though the user is required to load the T-shirt onto the platen 6 from the front side toward the rear side, the front end portion of the platen 6 (the left end portion in FIG. 9) is raised toward the upward direction. Therefore, the user can easily load the T-shirt onto the platen 6 by sliding downwardly the T-shirt along the platen 6 in a slant direction.

Figure 10:
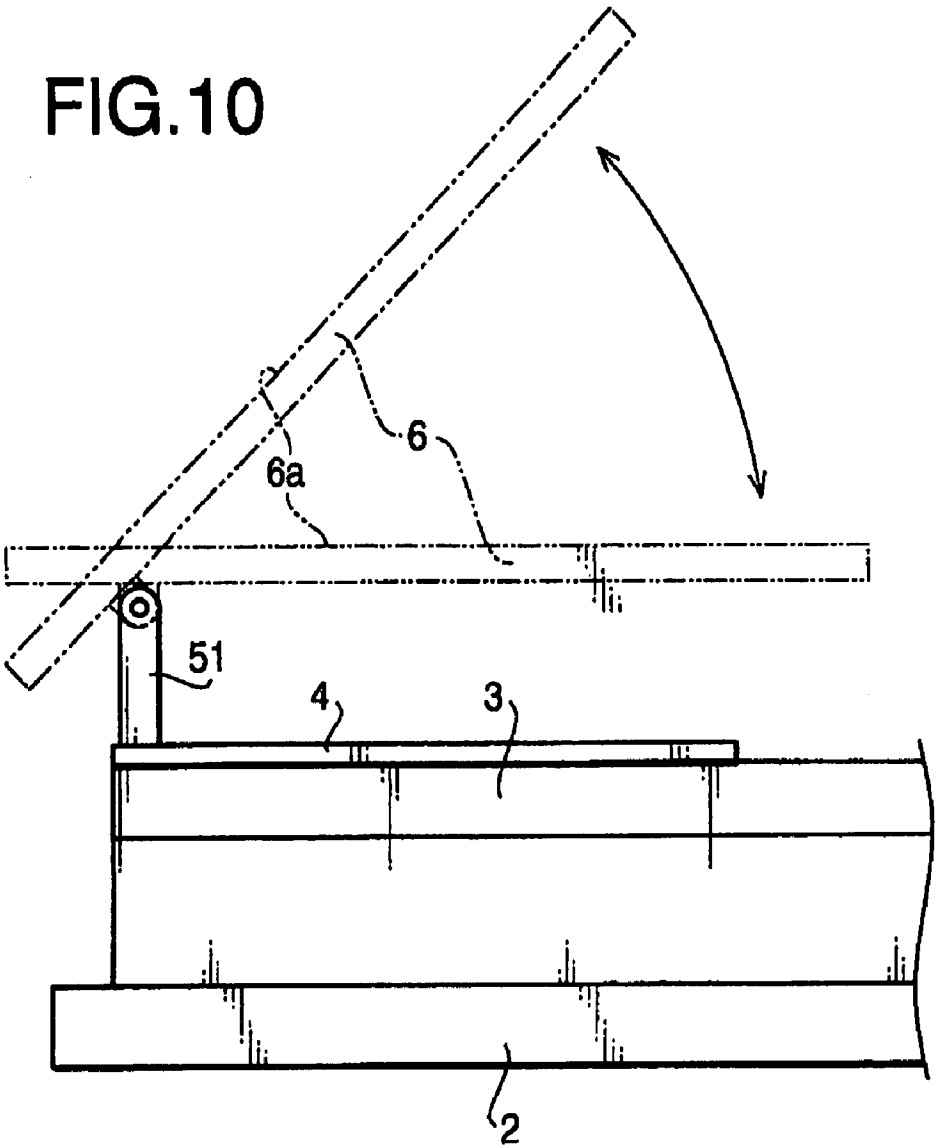
FIG. 10 is a side view of the inkjet printer illustrating a configuration in which the platen is directly raised toward a front side without using the carriage member.

The inkjet printer may be configured to use a relatively short straight support rod 51 in place of the support rod 5 (see FIG. 10). In this case, the rocking mechanism 17 and the shaft bearing 7 are located at the top end of the support rod 51, and the bottom end of the support rod 51 is fixed to the carriage member 4 at the front end. Similarly to the above mentioned embodiment, the platen 6 is rotated around the shaft bearing 7 toward the front side of the housing 2. Substantially the same advantage as the above mentioned embodiment is attained by the configuration shown in FIG. 10.

According to the configuration shown in FIG. 10, although the supporting surface 6*a* does not protrude toward the user from the housing 2 as in the case of the above mentioned embodiment since the platen 6 is directly rotated around the shaft bearings 7 (without using the supporting rod 5), the space required to rotate the platen 6 can be reduced. Therefore, downsize of the inkjet printer is attained.

Figure 11:
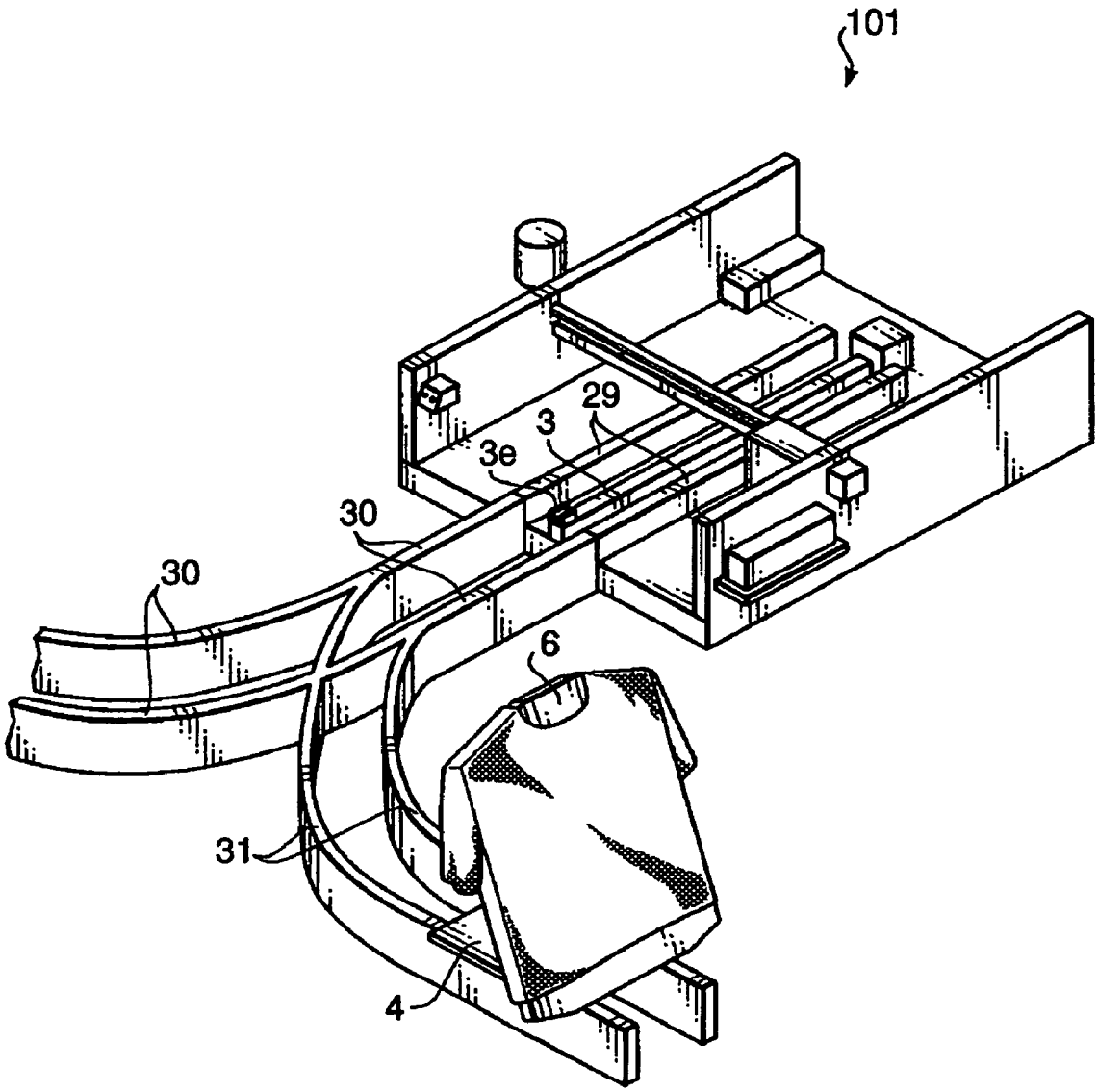
FIG. 11 shows an inkjet printer configured to include external guide rails which are connected to internal guide rails from the outside of the inkjet printer.

FIG. 11 shows an inkjet printer 101 configured to include external guide rails 30 and 31 which are connected to guide rails (located inside of the housing 2) from the outside of the housing 2. The external guide rails 30 and 31 are used to carry the carriage member 4 (a T-shirt) into the housing 2 and to carry the carriage member 4 (the T-shirt) out of the housing 2. With this configuration, it becomes possible to detach the T-shirt (which has been printed the image) from the platen 6 and to load the next T-shirt (which is to be printed the image) onto the platen 6 on the outside of the housing 2 while the current T-shirt is subjected to the printing operation.

Figure 12:
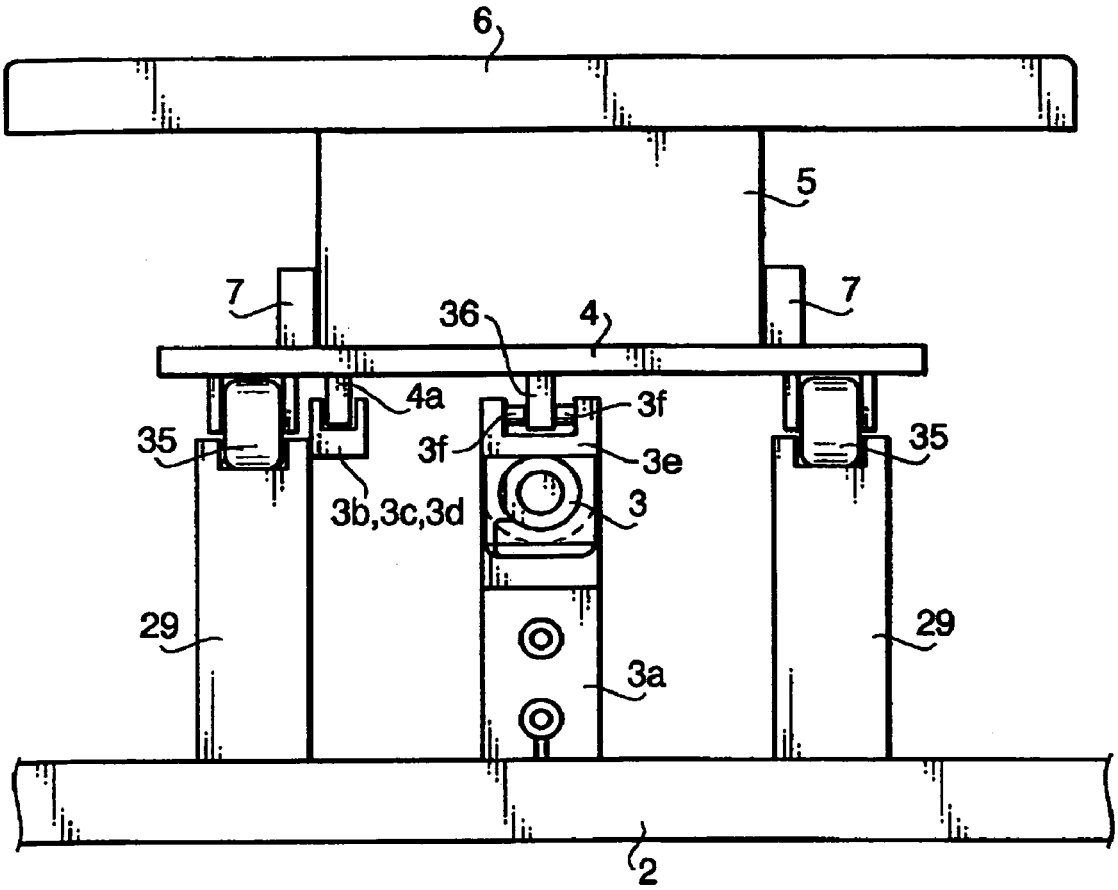
FIG. 12 is a front view of the inkjet printer shown in FIG. 11.

A detailed configuration of the inkjet printer 101 shown in FIG. 11 will be explained with reference to FIG. 12. FIG. 12 is a front view of the inkjet printer 101 illustrating a structure for carrying the carriage member 4. As shown in FIG. 12, rollers 35 are attached to the bottom surface of the carriage member 4. Further, the inkjet printer 101 is provided with guide rails 29 and 29 in place of the guide rails 3 and bases 3*a*. The carriage member 4 moves along the guide rails 29 in the anteropostrior direction.

At the central portion of the bottom surface of the carriage member 4, a disk 36, for example, formed of a metal plate, protruding downwardly in the vertical direction is formed. At the central portion on the bottom surface of the housing 2, the base 3*a* protruding upwardly in the vertical direction is provided. A disk catching member 3*e* is attached to the top of the base 3*a* via the guide rail 3, so that the disk catching member 3*e* is movable along the guide rail 29 in the anteroposterior direction by the driving force of the platen motor 8.

The disk catching member 3*e* has a pair of brake pads 3*f* and 3*f* which grip the disk 36. When the disk catching member 3*e* is moved by the driving force of the platen motor 8 while the brake pads 3*f* and 3*f* griping the disk 36, the carriage member 4 is carried along the guide rails 29 and 29.

Figure 13:
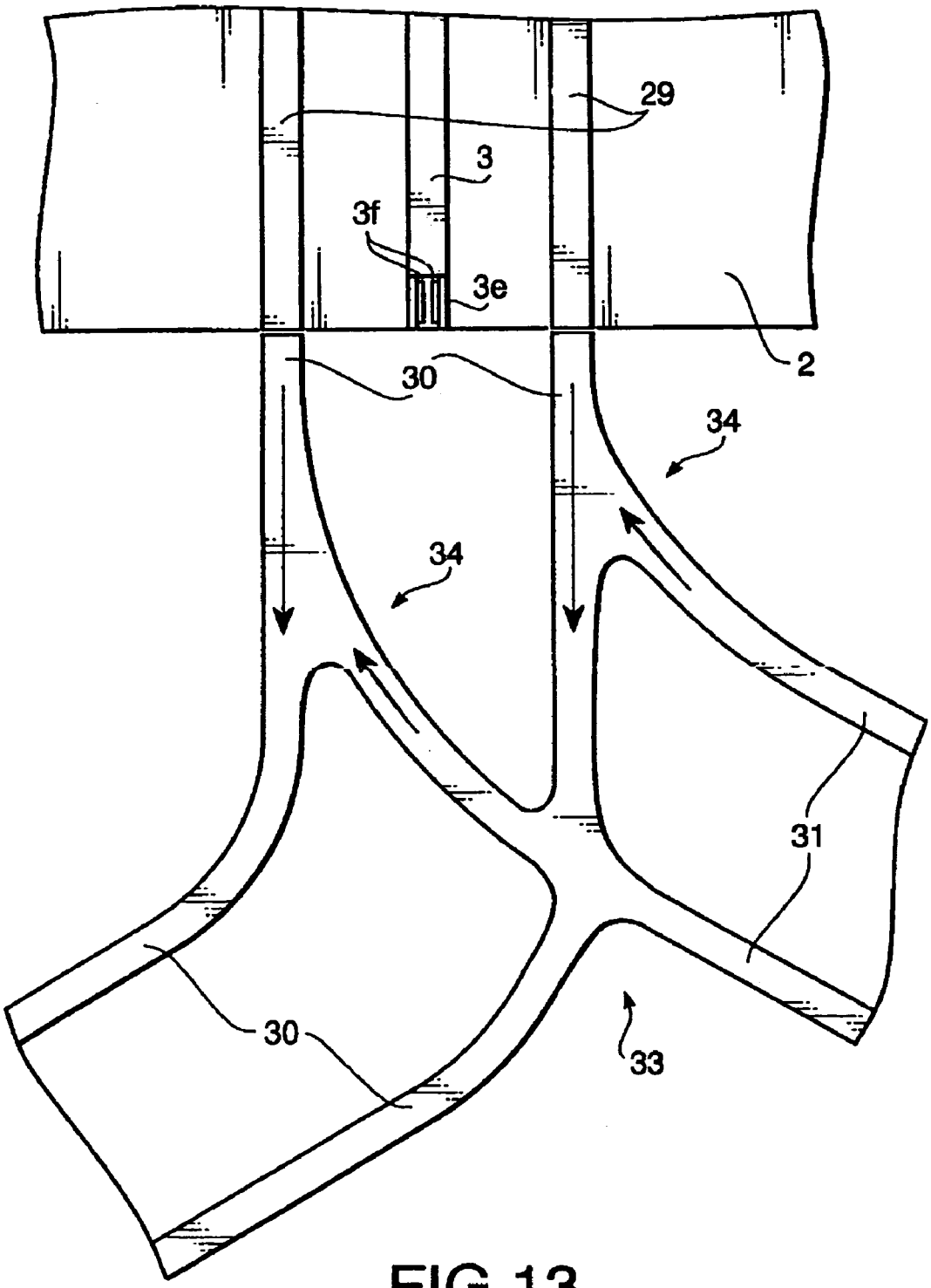
FIG. 13 shows a structure of the internal guide rails and the external guide rails when they are viewed as a top view.

The external guide rails 30 and 30 (31 and 31) are connected to the guide rails 29 and 29 as shown in FIG. 11, so that the carriage member 4 can be carried out of the housing 2 and can be sent into the housing 2 from the outside. FIG. 13 shows in detail a structure of the guide rails 29 and 29 and the external guide rails 30 and 31 when they are viewed as a top view.

As shown in FIG. 13, the guide rails 30 constitute a carrying path which is elongated straight from housing 2 side end portions and is curved leftward at a distance from the housing 2. The guide rails 31 constitute another carrying path which is joined to the carrying path of the guide rails 30, obliquely from the right side, at a position between the housing 2 side end portion and the curved portion of the guide rails 30.

With this structure of the guide rails 30 and 31, when the carriage member 4 proceeds toward the housing 2 from the outside along the guide rails 31 and 31, the rollers 35 of the carriage member 4 are guided from the carrying path of the guide rails 31 to the carrying path of the guide rails 30 at branch points 34 and 34 (see FIG. 13) on the straight portions of the guide rails 30, and then the rollers 35 are guided to the guide rails 29 and 29. Thus, the carriage member 4 is sent into the housing 2.

Preferably, the supporting surface 6*a* of the platen 6 is reclined and is oriented horizontally when the carriage member 4 is sent into the housing 2. When the carriage member 4 is sent into the housing 2, if the photo sensor 3*d* detects the shielding plate 4*a*, the brake pads 3*f* and 3*f* grip the disk 36 so that the carriage member 4 is moved by the driving force of the platen motor 8.

Then, the printing operation is performed. After the printing operation is finished, a gripped state of the disk 36 by the brake pads 3*f* and 3*f* is released when the photo sensor 3*d* detects the shielding plate 4*a*, so that the carriage member 4 can move freely. After the griped state of the disk 36 is released, the carriage member 4 further advances toward the front side and moves along the guide rails 30 and 30 if the external force is not applied to the carriage member 4. It is noted that the carriage member 4 is not guided toward the guide rails 31 and 31 if the external force is not applied to the carriage member 4.

Even if a weak force is applied to the carriage member 4, the carriage member 4 is not guided to the guide rails 31 and 31 because slanted surfaces are formed on the guide rails 31 at the branch points 34. Such slanted surfaces are also formed on the guide rails 30 at an intersection position 33 of the guide rails 30 and 31, so that the carriage member 4 is not guided to the guide rails 31 when the carriage member 4 proceeds from the housing 2 toward the outside along the guide rails 30.

With this configuration, the user can raise the platen 6 and loads/detach a T-shirt onto/from the platen 6 at the outside of the housing 2.

On the above mentioned structure (shown in FIGS. 11 through 13), end portions (not shown in FIGS. 11 through 13) of the guide rails 30 and end portions (not shown in FIGS. 11 through 13) of the guide rails 31 may be connected to each other so that ring-shaped guide rails are formed on the outside of the housing 2.

With this configuration, a user working in the ring-shaped guide rails can load/detach a T-shirt onto/from the platen 6 without changing his/her position in the ring-shaped guide rails. Consequently, the working efficiency is enhanced.

The guide rails 30 and 31 (and the ring-shaped guide rails) may be configured to have a driving mechanism (including the disk catching member 3*e* and a motor for driving the disk catching member 3*e* along the guide rails) for carrying the carriage member 4 along the guide rails (along the ring-shaped guide rails). In this case, automatic carrying operation for automatically sending the carriage member 4 into the housing 2 and for automatically carrying the carriage member 4 out of the housing can be attained. Consequently, the production efficiency is enhanced.

The present disclosure relates to the subject matter contained in Japanese Patent Application No. 2003-335790, filed on Sep. 26, 2003, which is expressly incorporated herein by reference in its entirety.

What is claimed is:

1. An inkjet printing device, comprising:

a holding unit that is used to hold a substrate to be subjected to printing operation;

a housing;

an inkjet head that ejects ink onto the substrate held by the holding unit and reciprocates in a lateral direction of the housing, wherein the holding unit is movable between a first posture which allows the inkjet head to eject the ink onto the substrate held by the holding unit and a second posture in which the substrate is loaded onto the holding unit, the holding unit is movable in an anteroposterior direction of the housing and reciprocates between a substrate set position at which the substrate is loaded onto the holding unit and a print position at which the inkjet head ejects ink onto the substrate, and the holding unit includes:

a platen rotatable around an axis extending in parallel with the lateral direction and rotates around the axis so that the platen is movable between the first posture in which the platen faces the inkjet head and the second posture in which the substrate is loaded onto the platen; and a locking mechanism that brings the platen into a locked state at the first posture and the second posture.

2. The inkjet printing device according to claim 1, further comprising a bearing that is located at one end portion of the holding unit to move the holding unit between the first posture and the second posture.

3. The inkjet printing device according to claim 2, wherein the holding unit is rotatably supported by the bearing at one end portion of the holding unit so that the holding unit is rotated, around the bearing, between the first posture and the second posture.

4. The inkjet printing device according to claim 1, wherein the holding unit has a holding surface on which the substrate is held, the holding surface facing the inkjet head when the holding unit is at the first posture, and wherein, at the first posture, the holding surface of the holding unit is oriented to a horizontal direction.

5. The inkjet printing device according to claim 1, wherein, at the second posture, the holding unit is raised such that an angle ranging from 10° through 120° is formed between the holding unit at the first posture and the holding unit at the second posture.

6. The inkjet printing device according to claim 1, wherein the holding unit is movably supported in a first direction.

7. The inkjet printing device according to claim 6, wherein the inkjet head is movably supported in a second direction different from the first direction.

8. The inkjet printing device according to claim 1, wherein when the holding unit is brought into the second posture, the holding unit is raised toward a front side of the inkjet printing device.

9. The inkjet printing device according to claim 8, wherein the front side is a side on which a user loads the substrate onto the holding unit.

10. The inkjet printing device according to claim 8, further comprising an operation panel for controlling the inkjet printing device, the operation panel being located on the front side of the inkjet printing device.

11. The inkjet printing device according to claim 1, wherein when the holding unit is at the second posture, the holding unit is raised toward a rear side of the inkjet printing device, and wherein the substrate is loaded by a user onto the holding unit from a front side of the inkjet printing device.

12. The inkjet printing device according to claim 1, further comprising a supporting member on which the holding unit is fixed, the holding unit being moved from the first posture to the second posture together with the supporting member.

13. The inkjet printing device according to claim 12, further comprising:

a carriage member that movably supports the supporting member so that the holding unit is fixed on the supporting member being moved between the first posture and the second posture; and a guide rail that slidably supports the carriage member so that the carriage member is moved along the guide rail.

14. The inkjet printing device according to claim 13, further comprising a housing that has a size for accommodating the holding unit, wherein the guide rail is formed to carry the carriage member into an inside of the housing from an outside of the housing and to carry the carriage member out of the housing.

15. An inkjet printing device, comprising:

a holding unit that is used to hold fabric to be subjected to printing operation;

a housing;

an inkjet head that ejects ink onto the fabric held by the holding unit and reciprocates in a lateral direction of the housing, wherein the holding unit is movable between a the first posture in which the inkjet head ejects the ink onto the fabric held by the holding unit and a second posture in which the fabric is easily loaded onto the holding unit, the holding unit is movable in an anteroposterior direction of the housing and reciprocates between a fabric set position at which the fabric is loaded onto the holding unit and a print position at which the inkjet head ejects ink onto the fabric, and the holding unit includes:

a platen rotatable around an axis extending in parallel with the lateral direction and rotates around the axis so that the platen is movable between the first posture in which the platen faces the inkjet head and the second posture in which the fabric is loaded onto the platen; and a locking mechanism that brings the holding unit into a locked state at the first posture and the second posture.

16. The inkjet printing device according to claim 15, further comprising a bearing that is located at one end portion of the holding unit to move the holding unit between the first posture and the second posture.

17. The inkjet printing device according to claim 15, wherein the holding unit has a holding surface on which the fabric is held, the holding surface facing the inkjet head when the holding unit is at the first posture, and wherein, at the first posture, the holding surface of the holding unit is oriented to a horizontal direction.

18. The inkjet printing device according to claim 15, wherein, at the second posture, the holding unit is raised such that an angle ranging from 10° through 120° is formed between the holding unit at the first posture and the holding unit at the second posture.

* * * * *